US006600123B1

(12) United States Patent
Rim et al.

(10) Patent No.: US 6,600,123 B1
(45) Date of Patent: Jul. 29, 2003

(54) CUTLESS ROTARY ARC GAP SWITCH AND DUAL TRIGGERING SYSTEM

(75) Inventors: Guen Hie Rim, Seoul (KR); Chu Hyun Cho, Changwon-shi (KR)

(73) Assignee: Korea Electrotechnology Research Institute, Chanwon (KR)

( * ) Notice: Subject to any disclaimer, the term of this patent is extended or adjusted under 35 U.S.C. 154(b) by 0 days.

(21) Appl. No.: 09/889,774

(22) PCT Filed: Oct. 28, 1999

(86) PCT No.: PCT/KR99/00649

§ 371 (c)(1),
(2), (4) Date: Jul. 20, 2001

(87) PCT Pub. No.: WO00/44016

PCT Pub. Date: Jul. 27, 2000

(30) Foreign Application Priority Data

Jan. 22, 1999 (KR) ..... 1999-1975

(51) Int. Cl.[7] ..... H01H 33/66
(52) U.S. Cl. ..... 218/123
(58) Field of Search ..... 218/123, 124, 218/125, 126–128, 130

(56) References Cited

U.S. PATENT DOCUMENTS 3,225,167 A * 12/1965 Greenwood ..... 218/123
3,727,018 A * 4/1973 Wesoloski et al. ..... 218/124

FOREIGN PATENT DOCUMENTS

| | | | |
|---|---|---|---|
| DE | 1765263 | 9/1971 | ..... H01H/33/66 |
| DE | 3407604 | 9/1985 | ..... H01H/33/66 |
| DE | 3613540 | 10/1987 | ..... A01C/17/00 |

OTHER PUBLICATIONS

PCT search Report for Application PCT/KR 99/00649 dated Jun. 23, 2000, pp.: 1–7.

* cited by examiner

*Primary Examiner*—Elvin Enad
*Assistant Examiner*—M. Fishman
(74) *Attorney, Agent, or Firm*—Howrey Simon Arnold & White, LLP

(57) ABSTRACT

A rotary arc gap (RAG) switch capable of handling large amounts of current flow is disclosed. The circular electrodes of the switch incorporate the use of a high-resistance material placed in a gap in the electrodes. The absence of an air gap in the electrodes reduces wear and broadening at the edges of the gap and thus improves the life span of the switch. Further disclosed is the use of a dual trigger mechanism that also improves the life span of the electrodes and the triggers.

12 Claims, 3 Drawing Sheets

CUTLESS ROTARY ARC GAP SWITCH AND DUAL TRIGGERING SYSTEM

CROSS REFERENCE TO RELATED APPLICATIONS

This application represents the national stage filing under 35 U.S.C. §371 of, and claims priority to, international (PCT) application PCT/KR99/00649, filed Oct. 28, 1999, which claims priority to Korean patent application 1999-1975, filed Jan. 22, 1999.

FIELD OF THE INVENTION

The present invention relates to a rotary arc gap (RAG) switch and a triggering system used in the switch. More particularly, the present invention relates to a cutless RAG switch wherein a high resistance material, instead of an air gap, is inserted into the electrodes of a RAG switch. Further, it relates to a dual triggering system wherein two triggers are used for the cutless RAG switch.

BACKGROUND OF THE INVENTION

A RAG switch is a switch that can withstand a great amount of current flow. Generally speaking, and referring to FIGS. 1 and 2, the switch comprises an upper circular electrode 1 connectable to a power supply, and lower circular electrode 2 connectable to a load. The switch generally controls the direction of current flow by forming a cut in the electrodes 1 and 2. To elaborate, an arc 5 revolves on an infinite trajectory due to the electromagnetic energy that is generated by the passage of current through the switch. The revolving arc 5 prevents the electrodes from becoming damaged when compared with a static arc that remains in one position. Therefore, the life span of the switch is maximized. In the prior art, and referring to FIG. 1, cuts are made in the electrodes to control the direction of current flow, such cuts constituting air gaps in the electrodes. The structure of conventional RAG switch electrodes 1 and 2 are shown in FIG. 1 in both planar and cross-sectional views.

However, in the prior art electrode structures involving the use of air gaps, as shown in FIG. 1, the velocity of arc 5 becomes slow at the corner section of the cut, thereby causing the structure of the cuts to wear and broaden, especially at the sharp edges of the cut. Consequently, the life span of the switch is shortened.

Additionally, another problem exists in the prior art in that the life spans of triggers and electrodes of the conventional triggering system used in the switch electrodes are reduced due to the use of only a single trigger.

SUMMARY OF THE INVENTION

The present invention solves the aforementioned problems. To prolong the life span of a RAG switch and to prevent wear and broadening at the air gaps cuts, a high resistance material is inserted into the cut of the switch electrodes. Additionally, the disclosed switch employs a dual triggering system using two triggers for the switch electrodes, thereby prolonging the life spans of triggers and switch electrodes.

DETAILED DESCRIPTION OF THE PREFERRED EMBODIMENTS

Figure 1:
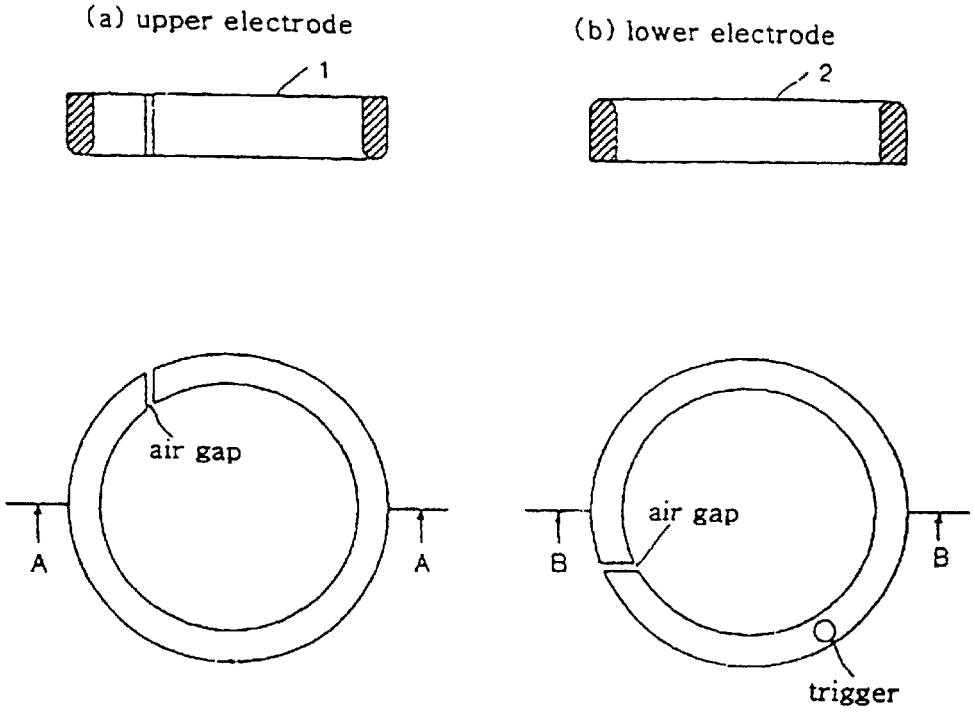
FIG. 1 shows cross-sectional and planar views of the electrodes of a conventional RAG switch utilizing air gap cuts.
Figure 2:
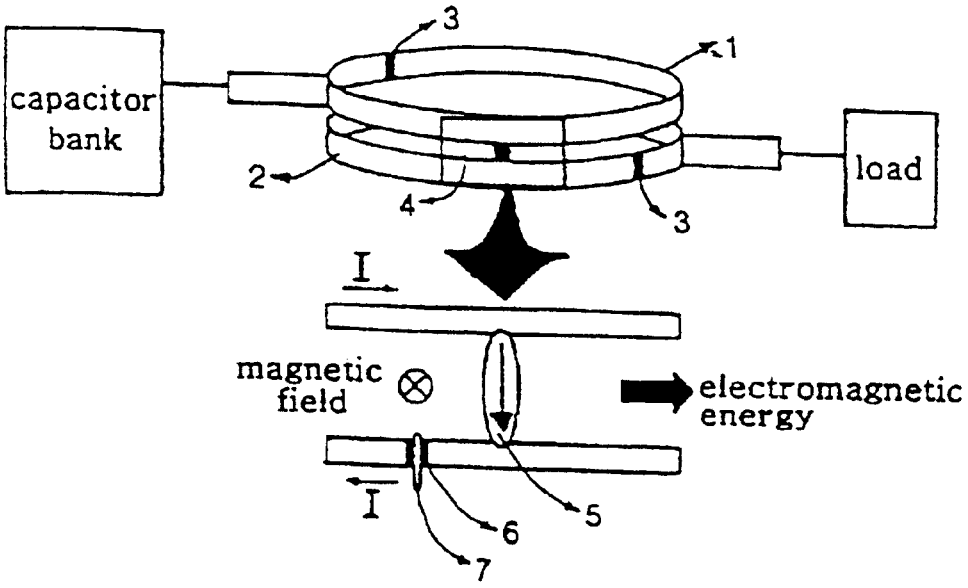
FIG. 2 shows perspective and side view of a preferred embodiment of the cutless RAG switch of the present invention.

FIG. 2 shows the construction of a cutless RAG switch according to an embodiment of the invention. The switch comprises an upper circular electrode 1 connectable to a power supply, and a lower circular electrode 2 connectable to a load which is separated from the upper electrode 1 by a certain distance. The first and second circular electrodes 1, 2 are concentric around an axis 15, which is perpendicular to the planar surfaces 11, 12 of each respective electrode. Also included is a primary high-resistance material 3 that is inserted into a cut in the lower electrode 2. A primary trigger 4 also is installed on the lower electrode 2 and disposed at a certain angle to said primary high-resistance material 3. A secondary high-resistance material 3 is inserted into a cut in the upper electrode 1, which is displaced at an angle of 180° relative to the primary high-resistance material 3 of the lower electrode 2.

The upper and lower electrodes 1 and 2 are positioned at a distance of approximately 10 millimeters from each other. As explained earlier, the upper electrode 1 is connected to a power supply (capacitor bank), and the lower electrode 2 is connected to a load. The primary and secondary high-resistance materials 3 are installed in the lower electrode 2 and the upper electrode 1 respectively. When the trigger is applied at a desired time, an arc 5 is formed between the upper electrode 1 and the lower electrode 2, thereby allowing the current to flow. The primary high-resistance material 3 of the lower electrode 2 can be inserted into any position of the electrode, but the secondary high-resistance material 3 of the upper electrode 1 should be so inserted at an angle of 180° with respect to the primary high-resistance material 3.

The materials for the primary and secondary high-resistance materials 3 can be alloys of iron and nickel, or alloys of iron and chromium. The specific constituents and the properties of such suitable alloys are provide in the below tables:

TABLE 1

| Name of | Constituent (%) | | Volume Resistance | Temperature Coefficient of Resistance | Tensile Strength | Density |
|---|---|---|---|---|---|---|
| Alloy | Fe | Ni | ($\mu\Omega$cm) | ($\times 10^{-4}$) | (kg/mm$^2$) | (g/cm$^3$) |
| Climax | 75 | 25 | 83.1 | 9.8 | — | 8.14 |
| Phenix | 75 | 25 | 83.1 | 11 | 49 | 8.10 |
| Imvar | 64 | 36 | 78~85 | 12 | 98 | 8.12 |

TABLE 2

| Class | Constituent (%) Cr | Al | Mn | C | Fe | Volume Resistance ($\mu\Omega$cm) | Temperature Coefficient of Resistance ($\times 10^4$) | | Tensile Strength (kg/mm$^3$) |
|---|---|---|---|---|---|---|---|---|---|
| Fe Cr Class 1 | 23~36 | 4~6 | 1.0 or more | 0.15 or less | Rest | 132~248 | 1.0 or less (200~400° C.) | 1.0 or less (20~100° C.) | 70 or more |
| Fe Cr Class 2 | 17~21 | 2~4 | 1.0 or more | 0.15 or less | Rest | 115~129 | 2.5 or less (200~400° C.) | 2.5 or less (20~900° C.) | 60 or more |

The primary trigger 4 is installed at a position on the lower electrode 2 that is equal to or greater than 30° from the location of the primary high-resistance material 3. The primary trigger 4, preferably tungsten 7 wrapped with teflon 6, generates an arc by operating at an desired time.

Figure 3:
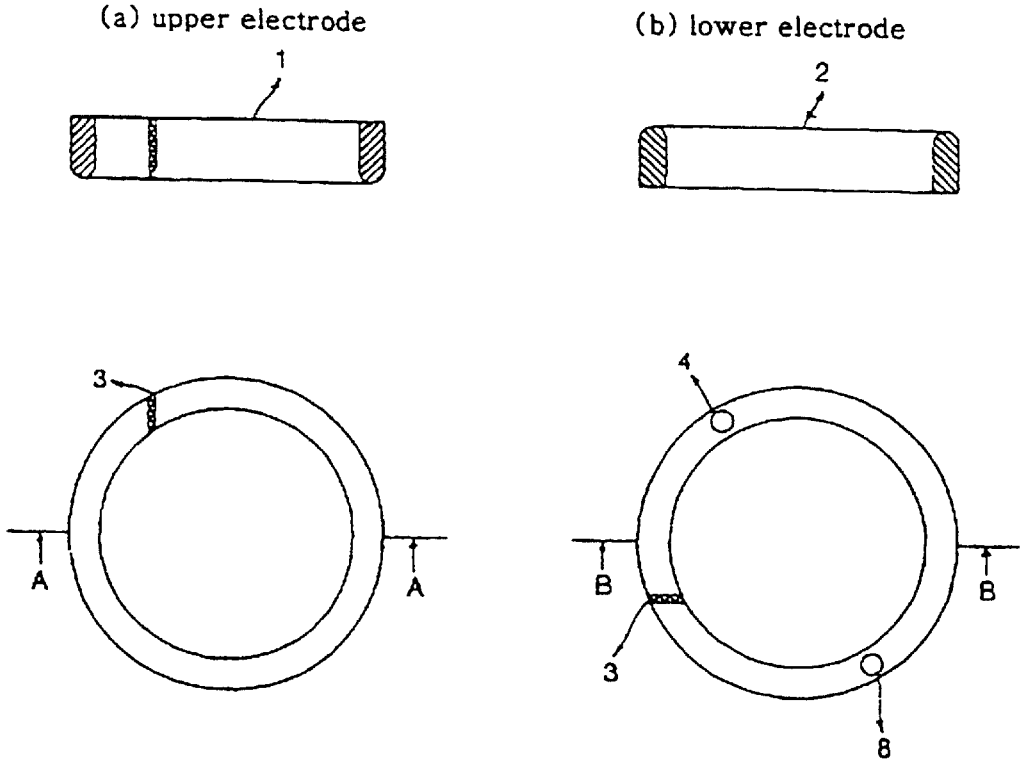
FIG. 3 shows cross-sectional and planar views of the electrodes of the switch of FIG. 2 and shows the use of dual triggers.

FIG. 3 shows cross-sectional and planar views of a cutless RAG switch that uses two triggers 4 and 8 according to the present invention. As shown in FIG. 3, the additional secondary trigger 8 is installed at an angle of 180° relative to the primary trigger 4. As mentioned before, the primary trigger 4 is inserted into the lower electrode 2 at an angle of 30° or more relative to the high-resistance material 3 of the lower electrode 2.

If the arcs 5 are generated at both the primary and secondary triggers 4 and 8, the current flows in a dispersed manner, and consequently, the life spans of electrodes are prolonged. If an arc 5 is generated at either one of the primary or secondary triggers 4 and 8, it is equivalent to the case in which a single trigger is used. Nevertheless, in this latter case, since an arc will be produced at either one of the triggers 4 or 8, the same amount of a trigger action can be generated when compared with a single trigger device while prolonging the life span of either triggers 4 and 8. In other words, the life span of a RAG switch can be prolonged because the life spans of electrodes and trigger electrodes are extended via the system as illustrated in FIG. 3.

In accordance with the disclosed embodiments, the life span of a RAG switch can be prolonged by preventing wear and broadening of the cut of an electrode though the insertion of a high-resistance material in the cut of the electrodes of conventional RAG switches. Further, the life spans of electrodes and trigger electrodes of RAG switches can be extended by virtue of the introduction of a dual triggering system.

What is claimed is:

1. A rotary arc gap switch, comprising:

a first circular electrode connectable to a power supply, wherein the first circular electrode is concentric about an axis that is perpendicular to a plane defined by the first circular electrode;

a second circular electrode connectable to a load, the first circular electrode being separated from the second electrode by a certain distance, wherein the second circular electrode is concentric about the axis that is perpendicular to the plane defined by the first circular electrode and perpendicular to a plane defined by the second circular electrode;

a first high-resistance material inserted into a first linear cut completely through the second circular electrode, wherein the first cut proceeds from a top to a bottom of the second circular electrode such that the first cut is parallel to the axis;

a first trigger installed at the second electrode at an angle with respect to the first high-resistance material; and a second high-resistance material inserted into a second linear cut completely through the first circular electrode and displaced approximately 180° relative to the first high-resistance material, wherein the second cut proceeds from a top to a bottom of the first circular electrode such that the second cut is parallel to the axis.

2. The rotary arc gap switch of claim 1, wherein either the first or second high-resistance material comprises an alloy comprising iron and nickel or an alloy comprising iron and chromium.

3. The rotary arc gap switch of claim 1, further comprising a second trigger installed at the second electrode and displaced approximately 180° to the first trigger.

4. The rotary arc gap switch of claim 3, wherein either the first or second high-resistance material comprises an alloy comprising iron and nickel or an alloy comprising iron and chromium.

5. The rotary arc gap switch of claim 1, wherein the angle between the first high-resistance material and the first trigger is equal to or greater than 30°.

6. An electrode for a rotary arc gap switch, comprising a circular electrode concentric about an axis that is perpendicular to a plane defined by the circular electrode and containing a linear gap completely through the electrode and parallel to the axis, wherein the gap is filled with a high-resistance material.

7. The electrode of claim 6, wherein the high-resistance material comprises an alloy comprising iron and nickel or an alloy comprising iron and chromium.

8. The electrode of claim 6, further comprising a first trigger.

9. The electrode of claim 8, wherein an angle between the high-resistance material and the first trigger is equal to or greater than 30°.

10. The electrode of claim 8, wherein the first trigger comprises tungsten coated with teflon.

11. The electrode of claim 8, further comprising a second trigger.

12. The electrode of claim 11, wherein the second trigger is placed on the electrode at approximately a maximum distance from the first trigger.

* * * * *